United States Patent [19]

Aoyama et al.

[11] 4,020,806

[45] May 3, 1977

[54] HYDRAULIC VALVE LIFTER FOR INTERNAL COMBUSTION ENGINE

[75] Inventors: Shunichi Aoyama; Yoshimasa Hayashi, both of Yokohama, Japan

[73] Assignee: Nissan Motor Co., Ltd., Yokohama, Japan

[22] Filed: Dec. 29, 1975

[21] Appl. No.: 645,253

[30] Foreign Application Priority Data

Dec. 28, 1974 Japan ..... 49-1405

[52] U.S. Cl. ..... 123/90.55; 123/90.56

[51] Int. Cl.[2] ..... F01L 1/24

[58] Field of Search ..... 123/90.55, 90.56, 90.57, 123/90.58, 90.59

[56] References Cited

UNITED STATES PATENTS

| | | | |
|---|---|---|---|
| 1,966,794 | 7/1934 | George | 123/90.55 |
| 2,220,336 | 11/1940 | Johnson | 123/90.55 |
| 2,346,737 | 4/1944 | Essl | 123/90.56 |
| 2,376,182 | 5/1945 | Peterson | 123/90.56 |
| 2,966,151 | 12/1960 | Wood | 123/90.55 |
| 3,163,158 | 12/1964 | Green | 123/90.56 |
| 3,304,925 | 2/1967 | Rhoads | 123/90.55 |
| 3,385,274 | 5/1968 | Shunta | 123/90.55 |
| 3,406,668 | 10/1968 | Donnelly | 123/90.56 |
| 3,658,038 | 4/1972 | Bergmann | 123/90.55 |
| 3,742,921 | 7/1973 | Rendine | 123/90.55 |

*Primary Examiner*—Charles J. Myhre
*Assistant Examiner*—Daniel J. O'Connor

[57] ABSTRACT

A hydraulic valve lifter for an automotive internal combustion engine, having a lifter cylinder formed with a first cylinder chamber contractable in response to a force exerted on the lifter from the cam on the engine camshaft and a second cylinder chamber contractable between a zero volume condition and a maximum volume condition in response to variation in the engine oil directed into the lifter, whereby the valve timings and valve lift are varied with the engine-oil-pump pressure that varies with engine speed.

5 Claims, 3 Drawing Figures

HYDRAULIC VALVE LIFTER FOR INTERNAL COMBUSTION ENGINE

The present invention relates in general to internal combustion engines of automotive vehicles and, particularly, to a hydraulic valve lifter forming part of a valve train of an automotive internal combustion engine.

As is well known in the art, the intake and exhaust valves of an internal combustion engine are timed by the contours of the cams on the engine camshaft so as to open and close the intake and exhaust ports, respectively, of the engine cylinders at the proper times for best engine performance, especially, for best volumetric efficiency of the engine. The valve timings are usually determined in an attempt to achieve maximum intake and exhaust efficiencies when the engine is operated to produce maximum torque with the revolution speed of, for example, about 3000 to 4000 rpm. The intake and exhaust valves thus timed are concurrently open at least in part at the end of the exhaust stroke and at the beginning of the intake stroke and gives a valve overlap period across the top-dead-center in each cycle of operation of the engine cylinder. During this part of the crankshaft rotation, the piston moves very little in the engine cylinder and the valves are moved very rapidly if the engine is operating at a high speed. When, however, the engine is being operated at a low speed as during idling, the valve overlap period increases relative to the velocity of the piston movement and, as a consequence, the air-fuel mixture admitted into the combustion chamber tends to blow by into the exhaust port or the burned exhaust gases to be discharged from the combustion chamber tend to be admixed to the air-fuel mixture entering the combustion chamber. This is not only detrimental to engine fuel economy but adds to the concentration of the toxic, unburned compounds in the exhaust gases as a result of the incomplete combustion of the mixture. The present invention contemplates elimination of the particular problem that has been inherent in the internal combustion engines of automotive vehicles.

To achieve this end, the present invention proposes to have the lifts and the opening and closing timings of the valve varied in proper relationship to the output speed of the engine by the use of the hydraulic valve lifter or tappet which is incorporated into the valve train of an internal combustion engine for the purpose of taking up clearance in the valve train.

In accordance with the present invention, such a concept is realized in a valve lifter comprising an axially movable lifter cylinder formed with axially aligned first and second axial bores which are continuous to each other, a plunger axially slidable in the first axial bore in the cylinder and defining in the first axial bore a main cylinder chamber continuous to the second axial bore and axially contractable and extendible respectively as the plunger is axially moved toward and away from the second axial bore, passageway means formed in the cylinder and the plunger for providing communication between the main cylinder chamber and a source of fluid under pressure, check valve means positioned within the main cylinder chamber for blocking the communication between the cylinder chamber and the fluid source in response to an increase of the fluid pressure in the main cylinder chamber over the fluid pressure developed in the passageway means, a floating piston axially slidable in the second axial bore in the cylinder for defining in the second axial bore an auxiliary cylinder chamber which communicates with the main cylinder chamber and which is continuously axially contractable between a zero volume condition and a maximum volume condition as the above mentioned floating piston is axially moved in the second axial bore in response to variation in the fluid pressure in the main cylinder chamber, and biasing means for urging the floating piston toward an axial position providing the zero volume condition of the auxiliary cylinder chamber.

The features and advantages of the valve lifter according to the present invention will become more apparent from the following description taken in conjunction with the accompanying drawings, in which.

Figure 3:
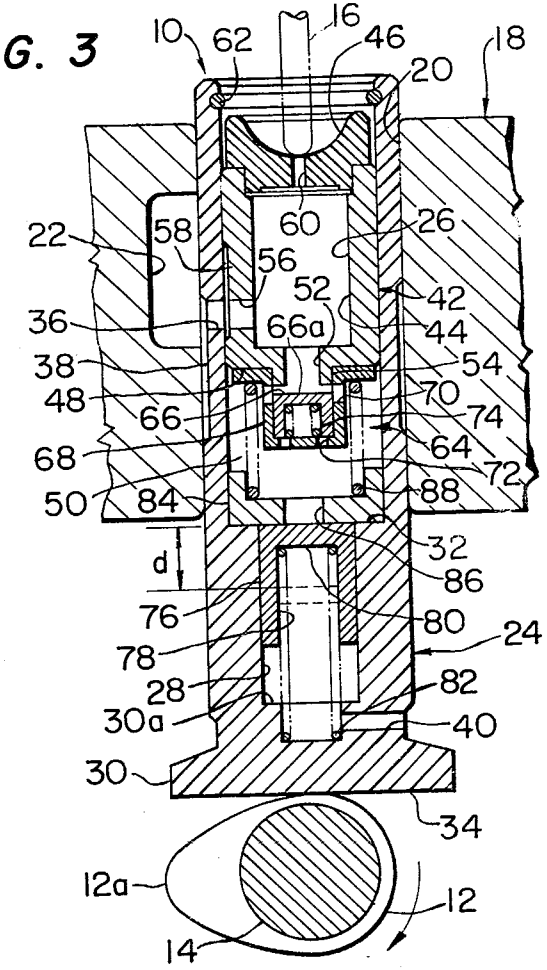
FIG. 3 is a longitudinal sectional view of a preferred embodiment of the valve lifter according to the present invention.
Figure 1:
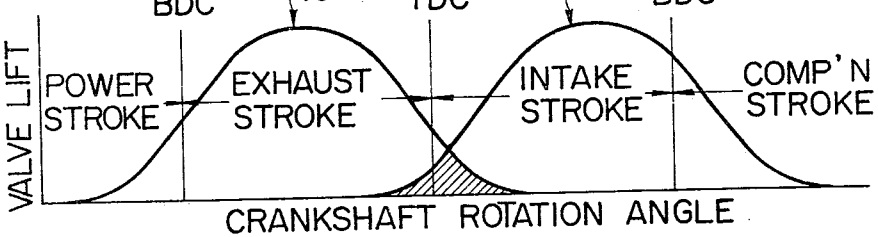
FIG. 1 is a graph showing examples of the performance characteristics of intake and exhaust valves controlled by a valve train using a prior art valve lifter.

Referring to the drawings, first to FIG. 1 thereof, curves V*a* and V*e* indicate the lifts, in terms of crankshaft rotation angle, of intake and exhaust valves, respectively, which are controlled by a conventional valve train of an internal combustion engine. The degrees of valve timing vary with the types, designs and makes of engines but are usually so determined that the intake valve starts to open at the crankshaft rotation angle (taken on the axis of abscissa) of about 10° to 20° before the top-dead-center (TDC) on the exhaust stroke in each cycle of operation of the engine and stays open until it closes at the crankshaft rotation angle of about 40° to 60° after the bottom-dead-center (BDC) on the compression stroke while the exhaust valve starts to open at the crankshaft rotation angle of about 50° before the bottom-dead-center on the power stroke and closes at the crankshaft rotation angle of about 10° to 20° past the top-dead-center on the intake stroke, as are well known in the art. Both intake and exhaust valves are thus open concurrently at the end of the exhaust stroke and at the beginning of the intake stroke of the engine and provide a valve overlap period across the top-dead-center between the consecutive exhaust and intake strokes, as indicated by a hatched area in FIG. 1. When the engine is operating at a relatively low speed, therefore, the air-fuel mixture tends to leak from the combustion chamber into the exhaust port and the burned gases tend to be admixed to the mixture entering the combustion chamber during the valve overlap period, as previously noted. A prime object of the present invention is to provide a valve train which is adapted to operate the intake and exhaust valves in accordance with the usually accepted schedules indicated by the curved V*i* and V*e* (indicated by broken lines in FIG. 2) during high-speed conditions of the engine but which is capable of having the valves initiated to open at retarded timings and to close at advanced timings and, furthermore, reducing the lifts of the valves when the engine is operated at a low speed. During idling of the engine the amounts of retardation and advance of the opening and closing timings of the valves become maximum and the lifts of the valves become minimum, as will be seen from curves Vi' and Ve' which show the lifts of the intake and exhaust valves, respectively, during the idling operation. The valve overlap period is in this fashion reduced as the engine slows down and disappears when the engine is operated at idle. FIG. 3 illustrates a preferred embodiment of the hydraulic valve lifter according to the present invention which intends to achieve the above described functions of the valves through improvements made in the valve lifter.

Referring to FIG. 3, a valve lifter or tappet 10 forming part of a valve train of an internal combustion engine intervenes between a cam 12 on a camshaft 14 and a member 16 connecting the lifter to the head of an intake or exhaust valve (not shown) of a cylinder of the engine. The connecting member 16 may be a push-rod in an I-head or overhead-valve engine or the stem of the intake or exhaust valve in an L-head engine. For convenience sake, the connecting member 16 is herein assumed to be a push-rod which is connected to the rocker arm (not shown) of the engine cylinder. The valve lifter 10 rides on the cam 12 and acts as a follower of the cam 12 which rotates with the camshaft 14. The camshaft 14 is rotatable about an axis perpendicular to the valve lifter 10 and is adapted to be driven from the crank-shaft (not shown) of the engine by a chain and sprocket arrangement or a gear combination as is well known in the art. The valve lifter 10 is supported by a suitable stationary structure of the engine such as for example the cylinder block 18 through an elongated opening 20 formed therein. The cylinder block 18 is formed with an engine oil gallery 22 which is in communication with the engine oil pump (not shown) which delivers lubricating oil for the engine when the engine is in operation.

The valve lifter 10 comprises a hollow cylinder 24 which is axially slidable through the opening 20 in the cylinder block 18 and which has opposite end portions projecting outwardly and inwardly from the cylinder block 18. The cylinder 24 has an outer peripheral surface which is exposed in part to the above mentioned engine oil gallery 22 in the cylinder block 18. The cylinder 24 is formed with a first axial bore 26 open at one end of the cylinder 24 and terminating approximately halfway of the cylinder and a second axial bore 28 contiguous at one end to the first axial bore 26 and closed at the other end of the cylinder 24 by an end wall portion 30 of the cylinder 24. The second axial bore 28 is smaller in diameter than the first axial bore 26 so that the cylinder 24 is formed with an annular internal face 32 defining the inner end of the first axial bore 26 as shown. The volume, especially the length, of the second axial bore 28 is determined in relation to the volume of the first axial bore 26 depending upon the desired performance characteristics of the valve lifter 10, as will be described later. The end wall portion 30 of the cylinder 24 has a smooth, preferably slightly concave end face 34 which is in contact with the cam 12 on the camshaft 14. The cylinder 24 has formed in its cylindrical wall portion defining the axial bore 26 an opening 36 providing communication between the axial bore 26 and the above mentioned engine oil gallery 22 in the cylinder block 18. To enable the opening 36 to establish constant communication between the oil gallery 22 and the axial bore 26 in the cylinder 24 which is axially movable relative to the cylinder block 18, the cylindrical wall portion of the cylinder 24 is formed with an undercut 38 extending axially in opposite directions from the raidally outer end of the opening 36 as shown. The cylinder 24 is further formed with a vent 40 in its cylindrical wall portion adjacent the closed end of the second axial bore 28 for providing constant communication between the axial bore 28 and the open air, for the reason which will be clarified as the description proceeds.

A hollow plunger 42 is axially slidable in the first axial bore 26 in the cylinder 24 thus configured. The plunger 42 is formed with an axial bore 44 which is closed at its axially outer end by a push-rod seat member 46. The plunger 42 has an end wall portion 48 at its axially inner end and, thus, forms in the first axial bore 26 in the cylinder 24 a cylinder chamber 50 which is defined between the end wall portion 48 of the plunger 42 and the previously mentioned annular internal face 32 of the cylinder 24. The cylinder chamber 50 is axially collapsible and extensible as the cylinder 24 and the plunger 42 are axially moved relative to each other. The end wall portion 48 of the plunger 42 is formed with an opening 52 for providing communication between the bore 44 in the plunger 42 and the above mentioned cylinder chamber 50. The end wall portion 48 further has an annular projection 54 encircling the axially outer end of the opening 52. The plunger 42 has formed in its cylindrical wall portion an opening 56 which is in constant communication with the opening 36 in the cylinder 24. To assure the constant communication between the openings 36 and 56, the cylindrical wall portion of the plunger 42 is formed with an undercut 58 extending axially in opposite directions from the radially outer end of the opening 56 in the plunger 42 as shown. As an alternative to the undercut 58 formed in the plunger, an undercut may be formed in the cylinder 24 in a manner to extend axially in opposite directions from the radially inner end of the opening 36 in the cylinder 24 though not shown. Constant communication is thus established between the axial bore 44 in the plunger 42 and the engine oil gallery 22 in the cylinder block 18 through the openings 36 and 56 even when the cylinder 24 and the plunger 42 are axially moved relative to each other and to the cylinder block 18. The push-rod seat member 46 has a semicylindrically concave outer face for slidably receiving thereon the leading end of the push-rod 16. The seat member 46 is usually formed with an aperture 60 for providing communication between the axial bore 44 in the plunger 42 and the passageway (not shown) formed in the push-rod 16 for conducting engine oil from the bore 44, through the passageway in the push-rod 16 to the rocker arm (not shown), where the oil lubricates the rocker arm assembly as is well known in the art. Designated by reference numeral 62 is a retainer for preventing the plunger 42 from being moved out of the cylinder bore 26.

The valve lifter 10 further comprises a check valve assembly 64 which is mounted on the end wall portion 48 of the plunger 42. The check valve assembly 64 comprises a cup-shaped valve element 66 having a disc portion engageable with the annular projection 54 of the end wall portion 48 of the plunger 42. The valve element 66 is axially movably enclosed within a retainer 68 which has a flange portion secured to the end wall portion 48 of the plunger 42 and a cup-shaped portion projecting into the cylinder chamber 50. The retainer 68 is formed with apertures 70 in its cup-shaped portion for providing communication between the opening 52 in the end wall portion 48 and the cylinder chamber 50 when the valve element 66 is unseated from the annular projection 54 of the end wall portion 48 as shown. The cup-shaped portion of the retainer 68 is further formed with apertures 72 providing constant communication between the interior of the cup-shaped valve element 66 and the cylinder chamber 50 for the reason which will be understood as the description proceeds. The valve element 66 is slightly urged toward the annular projection 54 of the end wall portion 48 by means of a preload spring 74 which is seated between the valve element 66 and the retainer 68 as shown.

The arrangments thus far described of the plunger 42, push-rod seat member 46 and check valve assembly 64 are well known per se. When, thus, the intake or exhaust valve of the engine cylinder (not shown) is closed, oil which has been fed from the engine oil pump into the oil gallery 22 is forced into the axial bore 44 in the plunger 42 through the opening 36 in the cylinder 24 and the opening 56 in the plunger 42. As the oil enters the axial bore 44 in the plunger 42, it acts on the valve element 66 of the check valve assembly 64 through the opening 52 in the end wall portion 48 of the plunger 42 and forces the valve element 66 to be disengaged from the annular projection 54 of the end wall portion 48 as illustrated. Oil now passes from the bore 44 in the plunger 42 into the cylinder chamber 50 through the opening 52 in the end wall portion 48 of the plunger and the apertures 70 in the valve retainer 68, forcing the cylinder chamber 50 to axially extend. The plunger 42 is therefore urged toward the push-rod 16 and takes up clearance between the push-rod 16 and the push-rod seat member 46 and, at the same time, the cylinder 24 is urged toward the cam 12 on the camshaft 14 and, thus, takes up clearance between the cam 12 and the slide end face 34 of the cylinder 24. When the valve element 66 is moved away from the annular projection 54 of the end wall portion 48 of the plunger 42 as above described, the oil filling the space between the valve element 66 and the cup-shaped portion of the valve retainer 68 is allowed into the cylinder chamber 50 through the apertures 72 in the retainer 68.

Now, when the cam 12 in slidable contact with the slide end face 34 of the cylinder 24 is rotated with the camshaft 14 in synchronism with the engine crankshaft (not shown) and has its lobe brought into contact with the slide end face 34, the cylinder 24 is axially moved away from the camshaft 14 and causes the cylinder chamber 50 to axially contract. This creates a sudden increase in the pressure of the oil in the cylinder chamber 50 and causes the valve element 66 to move onto the annular projection 54 of the end wall portion 48 of the plunger, thereby closing the opening 52 in the end wall portion 48. The oil which has been directed into the cylinder chamber 50 is now trapped in the chamber 50 and hydraulically locks the operating length of the valve lifter 10, which thus acts as a simple one-piece lifter. The lifter 10 moves as a solid unit away from the camshaft 14 and causes the intake or exhaust valve of the engine cylinder to open. Then, when the lobe of the cam 12 moves out of engagement with the slide end face 34 of the cylinder 24, the valve spring on the intake or exhaust valve forces the valve to close and the lifter 10 to move backwardly toward the camshaft 14. This causes reduction of the pressure on the oil in the cylinder chamber 50 and lowers the valve element 66 to be disengaged from the plunger 42. Communication is for a second time provided between the cylinder chamber 50 and the axial bore 44 in the plunger 42 so that the oil from the engine oiling system is again forced past the check valve assembly 64 to replace whatever oil that may have leaked from the cylinder chamber 50.

Figure 2:
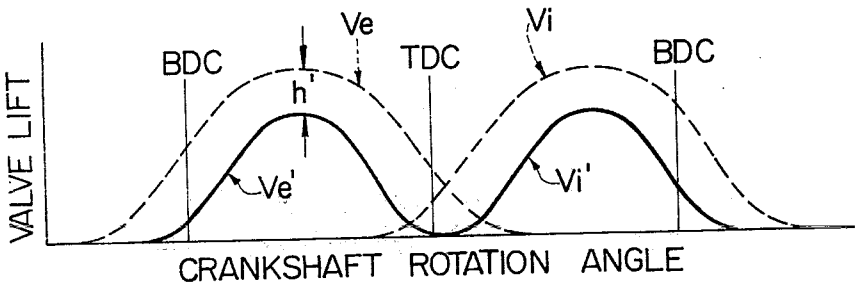
FIG. 2 is a graph similar to FIG. 1 but shows the performance characteristics of intake and exhaust valves controlled by valve trains using the valve lifters embodying the present invention.

In the prior art valve lifter, the lifter cylinder is formed with the first axial bore 26 alone and, for this reason, the cylinder chamber 50 has a fixed maximum volume which is predetermined to provide the valve timing schedule that will provide the valve lift indicated by the curve V*i* or V*e* in FIGS. 1 and 2. The valve lifter embodying the present invention is characterized in that the maximum volume of the cylinder chamber 50 is variable in proper relationship with the engine speed which is approximated from the pressure of engine oil directed into the lifter 10 from the oil gallery 22.

The valve lifter 10 embodying the present invention thus comprises, in addition to the plunger 42 and the check valve assembly 64, a floating piston 76 which is axially slidable in the second axial bore 28 in the cylinder 24. The floating piston 76 has an axial bore 78 which is open at its end closer to the end wall portion 30 of the cylinder 24 and closed at the opposite end by an end wall portion 80 facing the above mentioned cylinder chamber 50. The floating piston 76 is urged axially away from the end wall portion 30 of the cylinder 24 by suitable biasing means such as a preload spring 82 which is seated at one end on the inner faces of the end wall portions 30 and 80 of the cylinder 24 and the floating piston 76, respectively, as shown. The movement of the floating piston 76 toward the first axial bore 26 is limited by a balancing piston 84 which is axially slidable in the cylinder chamber 50 and which is formed with an opening 86. The balancing piston 84 is axially urged to rest on the previously mentioned annular internal face 32 of the cylinder 24 by suitable biasing means such as a preload spring 88 which is seated at one end on the balancing piston 84 and at the other end on the flange portion of the valve retainer 68. When the valve lifter 10 is in use, the balancing piston 84 is biased toward the position contacting the annular internal face 30 not only by the force of the preload spring 88 but the pressure of oil in the cylinder chamber 50. The valve element 66 is formed with an orifice **66*a* providing constant but restricted communication between the cylinder chamber 50 and the axial bore 44 in the plunger 42 through the opening 52 in the end wall portion 48 of the plunger. In the event the pressure of oil in the cylinder chamber 50 happens to lower excessively due to leakage of oil from the chamber and as a consequence the cylinder chamber 50 tends to contract. The preload spring 88 maintains the volume of the chamber 50 and causes the oil to be forced from the bore 44 in the plunger 42 into the cylinder chamber 50 through the orifice 66*a* in the valve element 66 and the apertures 72 in the valve retainer 68 under the influence of the suction induced in the cylinder chamber 50. The balancing piston 84 is, thus, held in the position in contact with the annular internal face 32 the cylinder. The balancing piston 84 held in this position has an outer end face located at the inner end of the second axial bore 28 in the cylinder 24, as illustrated. The floating piston 76 in the second axial bore 28 is, accordingly, axially movable between a first position remotest from the end wall portion 30 of the cylinder 24 and thus having its end wall portion 80 in contact with the balancing piston 88 in the above described position thereof as indicated by full lines and a second position remotest from the balancing piston 88** and having its open end in contact with the annular internal face 30*a* of the end wall portion 30 of the cylinder 24 as indicated by broken lines. The distance of stroke of the floating piston 76 thus movable between the above mentioned first and second positions is indicated by *d* in FIG. 3. The preload spring 82 urges the floating piston 76 to be held in the first position thereof. When the floating piston 76 is held in the first position by the force of the preload spring 82, the end wall portion 76 of the floating piston 76 is in contact with the balancing piston 84 serving as a stop for the floating piston 76 and, accordingly, has its outer face exposed in part to the oil in the cylinder chamber 50 through the opening 86 in the balancing piston 84. When the floating piston 76 is moved from the first position into the second position against the opposing force of the preload spring 82, then the end wall portion 80 of the floating piston 76 is spaced a distance *d* from the end face of the balancing piston 84 and forms a chamber in the second axial bore 28 between the end faces of the floating and balancing pistons 76 and 84 though not seen in the drawings. The particular chamber, herein called the auxiliary cylinder chamber in contrast to the main cylinder chamber 50, is in communication with the main cylinder chamber 50 through the opening 86 in the balancing piston 84 and is continuously contractable from a maximum volume condition provided by the floating piston 76 in the second position to a zero volume position provided by the piston 76 in the first position. The axial position of the floating piston 76 relative to the cylinder 24, viz., the volume of the auxiliary chamber is determined by the equilibrium condition between the force of the preload spring 82 and the oil pressure which is exerted on the end wall portion 80 of the floating piston 76 from the main cylinder chamber 50 through the opening 86 in the balancing piston 84. In other words, the volume of the auxiliary chamber varies with the oil pressure developed in the main cylinder chamber 50 because the spring constant of the preload spring 82 opposing the oil pressure is preselected. The space in the second axial bore 26 between the end wall portions 30 and 80 of the cylinder 24 and the floating piston 76 thus arranged is in constant communication with the open air through the vent 40 so that air in the particular space is allowed out of the space when the floating piston 76 is moved toward the second position thereof.

As is well known in the art, the pressure of the engine oil delivered from the engine oil pump varies with engine speed usually from about 5 kgs/cm$^2$ at maximum engine speed to about 1.5 kg/cm$^2$ during idling condition of the engine. When the intake or exhaust valve associated with the valve lifter 10 is open in the absence of a force which is exerted on the lifter cylinder 10 from the cam 12, the oil pressure developed in the main cylinder chamber 50 is equal to the oil pressure in the oil gallery 22 and is, therefore, in direct relation to the engine speed. The preload spring 82 acting on the floating piston 76 is, thus, selected so that the spring overcomes the oil pressure exerted on the floating piston 76 and forces the piston 76 into the first position thereof when the lowest engine oil pressure of, for example 1.5 kg/cm$^2$ occurs in the main cylinder chamber 50 under the idling condition of the engine and that the spring yields to the oil pressure on the floating piston 76 and allows the piston to be moved into the second position when the highest engine oil pressure of, for example, 5 kgs/cm$^2$ occurs in the main cylinder chamber 50 with the engine operating at a maximum speed.

When, thus, the engine is operating at the maximum speed, the floating piston 76 is maintained in the second position thereof providing the maximum volume of the auxiliary cylinder chamber, irrespective of the axial position of the plunger 42 relative to the cylinder 24. Under these conditions, the opening and closing timings and the lift of the intake or exhaust valve controlled by the valve lifter 10 are dictated by the sum of the amount of oil in the main cylinder chamber 50 and the amount of oil in the auxiliary cylinder chamber in the maximum volume condition. If, therefore, the valve lifter 10 as a whole is so designed that the sum of the volumes of the free spaces in the main and auxiliary cylinder chambers under the above described conditions is substantially equal to the volume of the free space in the cylinder chamber provided in a prior art valve lifter, then the intake or exhaust valve will be controlled to provide the performance characteristics following the curve V*i* or V*e* shown in FIGS. 1 and 2. As the engine speed is reduced below the maximum level and accordingly the engine-oil-pump pressure diminishes below the maximum level thereof, the oil pressure developed in the main and auxiliary cylinder chambers decline during the condition in which the intake or exhaust valve is open in the absence of a driving force exerted on the valve lifter 10 from the cam 10. The floating piston 76 is therefore moved from the second position toward the first position thereof over a distance corresponding to the decrement in the engine oil pressure by reason of the biasing force of the preload spring 82 until equilibrium is obtained between the force of the spring 82 and the oil pressure acting on the floating piston 76. The auxiliary chamber is thus contracted from its maximum volume condition into a partial volume condition. Now, when the cam 12 is rotated and forces the lifter cylinder 24 away from the camshaft 14 by the cam lobe 12*a*, the oil in the main and auxiliary cylinder chambers is squeezed with an increased pressure developed therein and forces the floating piston 76 to axially move back into the second position thereof against the opposing force of the preload spring 82. This causes the plunger 42 to move toward the auxiliary cylinder chamber over a distance substantially proportional to the distance of movement of the floating piston, producing retardation and advance of the opening and closing timings, respectively, of the valve and reducing the lift of the valve by amounts which are substantially proportional to the decrement of the engine oil pressure or, in other words, to the decrement of the engine speed. When the engine is being operated at idle with the engine oil pressure reduced to the lowest level thereof, the floating piston 76 is held in the first position thereof during the condition in which the intake or exhaust valve is open. When the lifter cylinder 24 is moved away from the camshaft 14 by the lobe 12*a* of the cam 12 under these conditions, the floating piston 76 is forced to move from the first position into the second position over the distance *d* indicated in FIG. 3. The opening and closing timings of the intake or exhaust valve are accordingly retarded and advanced, respectively, and at the same time the lift of the valve is reduced by amounts proportional to the distance *d* of movement of the floating piston 76, as indicated by *d'* in FIG. 2.

The valve lifter 10 embodying the present invention is thus operative to vary the opening and closing timings and the lift of the intake or exhaust valve of an engine cylinder with proper relationship to the variation in the engine speed, enabling the engine to achieve its maximum performance efficiency at maximum speed and reducing the valve overlap period to zero during idling.

What is claimed is:

1. A valve lifter for an automotive internal combustion engine, comprising an axially movable cylinder formed with axially aligned first and second axial bores which are continuous to each other, a plunger axially slidable in said first axial bore and defining in the first axial bore a main cylinder chamber contiguous to said second axial bore and axially contractable and extendible respectively as said plunger is axially moved toward and away from said second axial bore, passageway means formed in said cylinder and said plunger for providing communication between said main cylinder chamber and a source of fluid under pressure, check valve means positioned within said main cylinder chamber for blocking the communication between the cylinder chamber and the fluid source in response to an increase in the fluid pressure in said main cylinder chamber over the fluid pressure developed in said passageway means, a floating piston means axially slidable in said second axial bore for defining in the second axial bore an auxiliary cylinder chamber which is in communication with said main cylinder chamber and which is continuously axially contractable between a zero volume condition and a maximum volume condition as said floating piston is axially moved in said second axial bore in response to variation in the fluid pressure in the main cylinder chamber, and biasing means for urging said floating piston toward an axial position providing said zero volume condition of said auxiliary cylinder chamber.

2. A valve lifter as claimed in claim 1, in which said floating piston means has a closed axial end and is axially movable in said second axial bore between a first position having said closed axial end contiguous to said first axial bore for providing said zero volume condition of said auxiliary cylinder chamber and a second position having said closed axial end located remotest from said first axial bore for providing said maximum volume condition of said auxiliary cylinder chamber.

3. A valve lifter as claimed in claim 1, further comprising a balancing piston axially slidable in said main cylinder chamber and formed with an opening providing communication between said main and auxiliary cylinder chambers, biasing means for urging said balancing piston toward an axial position having an axial end contiguous to said second axial bore, and passageway means constantly providing restricted communication between said main cylinder chamber and said passageway means communicating with said fluid source.

4. A valve lifter as claimed in claim 3, in which said second axial bore is smaller in diameter than said first axial bore with said cylinder formed with an annular internal face between the first and second axial bores, said balancing piston being onto said annular internal face by said biasing means associated therewith for limiting the axial movement of said floating piston into the position providing said zero volume condition of said auxiliary cylinder chamber.

5. A valve lifter as claimed in claim 1, in which said floating piston means further defines in said second axial bore a chamber hermetically isolated from said auxiliary cylinder chamber by the floating piston and in constant communication with the open air.

* * * * *